United States Patent [19]

Fredd

[11] 4,289,165

[45] Sep. 15, 1981

[54] EQUALIZING BALL VALVE MEMBER

[75] Inventor: John V. Fredd, Dallas, Tex.

[73] Assignee: Otis Engineering Corporation, Dallas, Tex.

[21] Appl. No.: 39,836

[22] Filed: May 17, 1979

[51] Int. Cl.[3] ..... F16K 13/22

[52] U.S. Cl. ..... 137/625.32; 166/324; 166/332; 251/209; 251/315

[58] Field of Search ..... 137/625.32; 166/332, 166/324; 251/207, 209, 315

[56] References Cited

U.S. PATENT DOCUMENTS

| | | | |
|---|---|---|---|
| 3,036,600 | 5/1962 | Vickery | 251/315 X |
| 3,134,405 | 5/1964 | White | 137/625.32 |
| 3,348,805 | 10/1967 | Sanctuary | 251/315 |
| 3,821,962 | 1/1972 | Mott | 166/324 X |
| 3,883,113 | 5/1975 | Kolb | 251/315 X |

*Primary Examiner*—Robert G. Nilson
*Attorney, Agent, or Firm*—H. Mathews Garland

[57] ABSTRACT

An equalizing ball valve member and valve apparatus for use in a tubing string in a well bore of an oil or gas well to isolate a lower portion of the well bore below a packer including a body having a longitudinal bore therethrough connectible in a well tubing string, a lower annular valve seat supported in the body for limited sliding movement, fluid seal means between the lower valve seat and the body, an upper annular valve seat supported in longitudinal spaced relation from the lower valve seat within the body, an equalizing ball valve member supported for rotation between opened and closed positions between the valve seats, pivot members secured with the ball valve member for rotating the valve member, and a longitudinally movable operator member coupled with the pivot members for moving the pivot members longitudinally while permitting the members to traverse an arcuate path as the ball valve member rotates between an open and closed positions. The ball valve member has equalizing flow courses which reduce valve and valve seat wear and improve operating characteristics. The valve apparatus is useful in various types of well installations for production and testing procedures. The ball valve member is useful in various valve apparatus design.

27 Claims, 20 Drawing Figures

EQUALIZING BALL VALVE MEMBER

This invention relates to valves and more particularly relates to equalizing ball valve members.

The particular valve apparatus in which the ball valve member of the invention is shown herein is disclosed and claimed in my co-pending U.S. application Ser. No. 911,186 filed May 30, 1978, now U.S. Pat. No. 4,230,185.

Valves using ball type valve members are often used to control flow under high pressure and flow conditions such as in oil and gas wells. Such ball valve members are usually confined between annular spherical shaped seats. During the opening of a conventional ball valve, just before opening begins, there is only line contact between the ball valve member and the downstream valve seat. High pressure differentials across such valve members create high local forces between the seats and the ball valve member which results in wire drawing the valve seats or scoring the sealing surfaces as the ball is rotated to open the valve. Damage is produced by either the mechanical forces produced by the high local stress on small areas of the valve seats or by flow damage from turbulence as line contact is broken between the ball valve members and the seats. The usual valve apparatus for pressure equalizing before valve opening has been a bypass around the ball valve member and a side port leading to the bypass. The bypass structure requires more space and increases valve cost and probabilities of valve malfunction. In a conventional ball valve, opening begins when the bore edge of the ball valve member rotates past the inner edge of the valve seat. Control of the opening between the valve member and seat when the valve is "cracked" or slightly opened is very difficult in a conventional ball valve and often produces erosion, turbulence, erratic flow, emulsification and other problems. Further, when using such a valve in a throttling mode, deposits tend to collect along the valve member and seat edges defining the opening.

It is therefore a principal object of the invention to provide a new and improved ball valve member especially useful in high pressure installations such as oil and gas wells.

It is another object of the invention to provide a tubing valve using upper and lower valve seats and a new and improved ball valve member adapted to equalize a pressure differential across the member preliminary to valve opening.

It is another object of the invention to provide a new and improved equalizing ball valve member which provides substantially improved controlled equalization across the member during rotation of the valve member to an open position.

It is another object of the invention to provide an improved ball valve member which is operable by a reduced force.

It is another object of the invention to provide a ball valve member which permits easier angular control of the member when initiating flow through a valve.

It is another object of the invention to provide a ball valve member which produces reduced valve member and valve seat wear by diverting flow throttling from the inner seat lip to the outer seat lip.

It is another object of the invention to provide a ball valve member which has improved wear characteristics due to 360° ball-seat contact when flow is initiated.

It is another object of the invention to provide a ball valve member which produces controlled jetting and cleaning of body cavity and flow courses as the valve member is opened.

It is another object of the invention to provide a ball valve member which has improved wear characteristics due to reduced angular travel between closed and flow initiating positions.

It is another object of the invention to provide a ball valve member which combines high and low flow capacities in a single valve.

It is another object of the invention to provide a new and improved equalizing ball valve member having flow course means which provides communication past the valve member and seats preliminary to full opening of the valve for equalizing a pressure differential across the valve.

It is another object of the invention to provide a ball valve member which is more accurately controlled for throttling flow than a conventional ball valve member.

In accordance with the invention there is providing an equalizing ball valve member useful in a valve apparatus including a valve body having a longitudinal bore and connectible in a well tubing string, a lower annular valve seat supported in the valve body, seal means between the valve body and the lower seat, an upper annular valve seat supported in spaced relation within the valve body from the lower valve seat, the ball valve member having a bore therethrough and being rotatably supported in the valve body between the valve seats for movement between a closed position at which the valve member bore is misaligned from the bore through the valve body and an open position at which the valve member bore is aligned with the bore through the valve body, a valve operator member longitudinally movable within the valve body, and pivot means coupled between the operator member and the ball valve member for rotating the ball valve member between open and closed positions. Further, in accordance with the invention, the ball valve member has flow course defining structures which provides fluid communication past the valve seats and ball valve member prior to full opening of the valve member.

The foregoing objects and advantages of the invention will be better understood from the following detailed description of a preferred embodiment of an equalizing ball valve member constructed in accordance with the invention taken in conjunction with the accompanying drawings wherein:

FIG. 1 is a schematic fragmentary longitudinal view in section and elevation of a well system incorporating a valve having the ball valve member of the invention showing the valve closed and an upper tubing string positioned preparatory to insertion into the valve for opening the valve or alternatively, at a position immediately after retrieval of the string from the valve leaving the valve closed;

FIG. 11 is a top view of the ball valve member as represented in FIGS. 9 and 10 as seen from a plane parallel with the longitudinal axis through the bore of the vlave member and perpendicular to the plane in which FIG. 10 is shown to illustrate one of the side faces of the ball valve member on which one of the equalizing flow courses is formed on the valve member;

Figure 1:
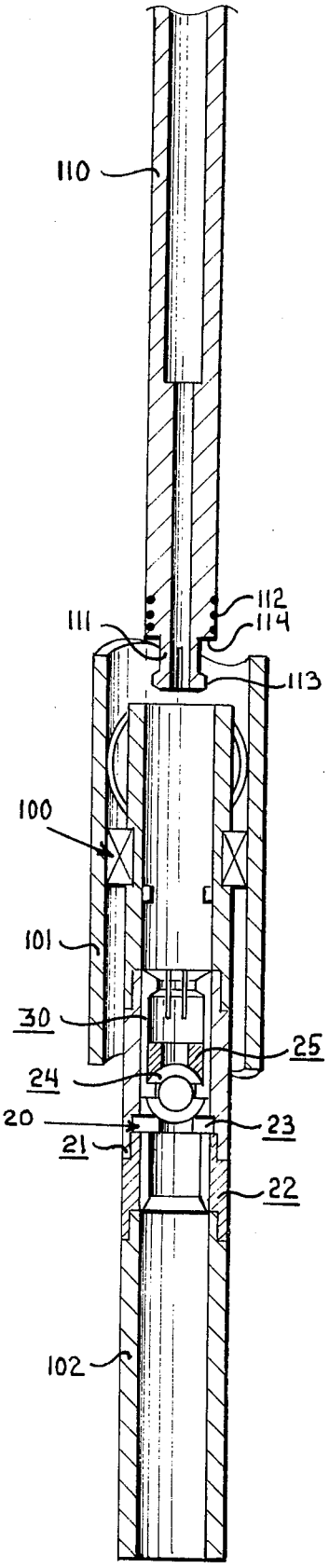

Referring to FIGS. 3–6, a well valve 20 including an equalizing ball valve member embodying the features of the invention includes a valve body 21, a bottom sub 22, a lower valve seat 23, an equalizing ball valve member 24, an upper valve seat 25, a valve operator 30, and pivots 31 coupling the valve operator with the ball valve. The ball valve member 24 is rotated between the closed position shown in FIG. 3 and the open position of FIG. 4 by longitudinal movement of the valve operator 30. The pivots 31 slide transversely in the valve operator while traversing an arcuate path rotating the ball valve between the open and closed positions. The lower and upper seats and the ball valve do not travel longitudinally while the valve is opened and closed by rotating the ball valve. A seal is effected between the lower seat and the ball valve sealing against a pressure differential across the valve in either direction. In accordance with the invention, surface features on the ball valve member define equalizing flow courses.

The valve body 21 is internally threaded at 32 for connection on the externally threaded lower end portion of an upper tubing string 33. The valve body has an internal annular recess 34 below the threads 32 in which a ring seal 35 is disposed for sealing between the lower end portion of the tubing string 33 and the valve body. The valve body also has an internal annular downwardly and inwardly sloping locking shoulder 40, a reduced bore portion 41 below the locking shoulder, a downwardly and outwardly sloping internal annular shoulder surface 42, an enlarged bore portion 43, an internal annular downwardly facing stop shoulder 44, and a further enlarged bore portion 45 below the stop shoulder 44. The lower end portion of the valve body is internally threaded at 50 for engagement on the bottom sub 22. A ring seal 51 is disposed in an internal annular recess 52 of the bottom sub sealing between the bottom sub and the lower end portion of the valve body. The lower end portion of the bottom sub is externally threaded at 53 for connection with a lower tubing string.

The bottom sub 22 has an upwardly opening enlarged bore portion 54 defined above an internal annular upwardly facing stop shoulder 55. The bottom sub has a further reduced bore portion 60 above an internal annular stop shoulder 61. The annular lower seat 23 has an enlarged external annular portion 62 which fits in a sliding relationship in the bottom sub bore portion 54. The lower seat 23 has a further reduced portion 64 below an external annular shoulder 65 on the lower seat. The seat portion 64 slides in the bottom sub bore portion 60. A back-up ring 70 and a ring seal 71 are fitted around the lower seat portion 64 within the bottom sub bore portion 54 between the lower seat shoulder 65 and the bottom sub shoulder 55 to support the lower seat in the bottom sub and to seal between the lower seat and the bottom sub. The upper end of the lower seat 23 is provided with an internal annular spherical shaped valve seat 72 which is engageable in a sealing relationship with the spherical surface of the valve member 24 for sealing against pressure both upwardly and downwardly. The lower seat 23 is therefore captured between the ball valve member and the bottom sub so that the seat is limited against longitudinal travel being permitted to move longitudinally only sufficiently to effectively form a seal at seat 72 with the valve member.

Figure 6:
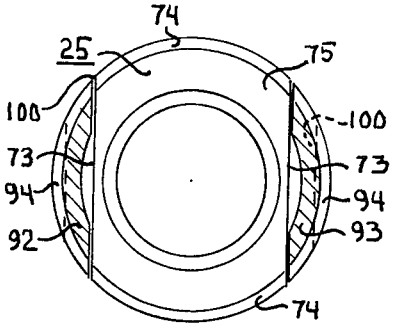
FIG. 6 is a view in section along the line 6—6 of FIG. 5.
Figure 5:
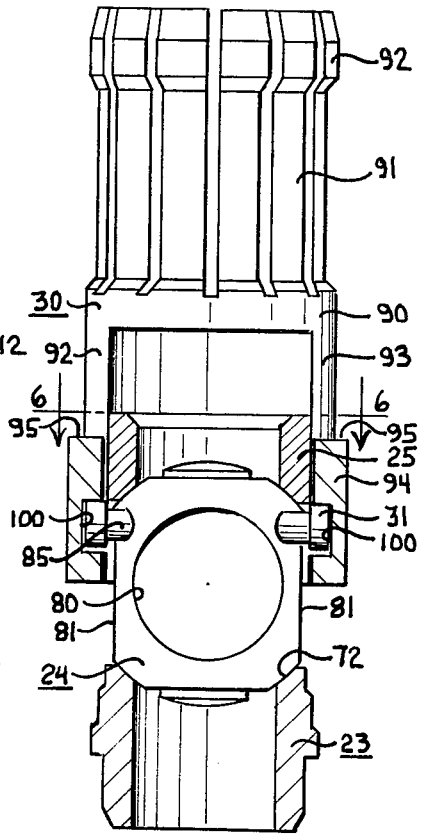
FIG. 5 is a view in section and elevation showing the principal operating parts of the valve removed from the valve body showing the ball valve member of the invention at a closed position.

The upper seat 25 is an annular member having an internal annular spherical seat surface 73 engageable with the spherical surface of the ball valve 24. The upper seat has flat opposite side faces 73 and opposite external arcuate flange portions 74 extending between the side faces 73 as shown in FIG. 6. The arcuate flange portions 74 extend outwardly sufficiently to engage the downwardly facing internal annular stop shoulder 44 within the valve body 21 thereby holding the upper seat against upward movement in the valve body so that the upper seat is captured between the ball valve 24 and the valve body stop shoulder 44. The flange portions 74 are effectively opposite or transverse extensions of the upper end face 75 of the upper valve seat 25.

Figure 3:
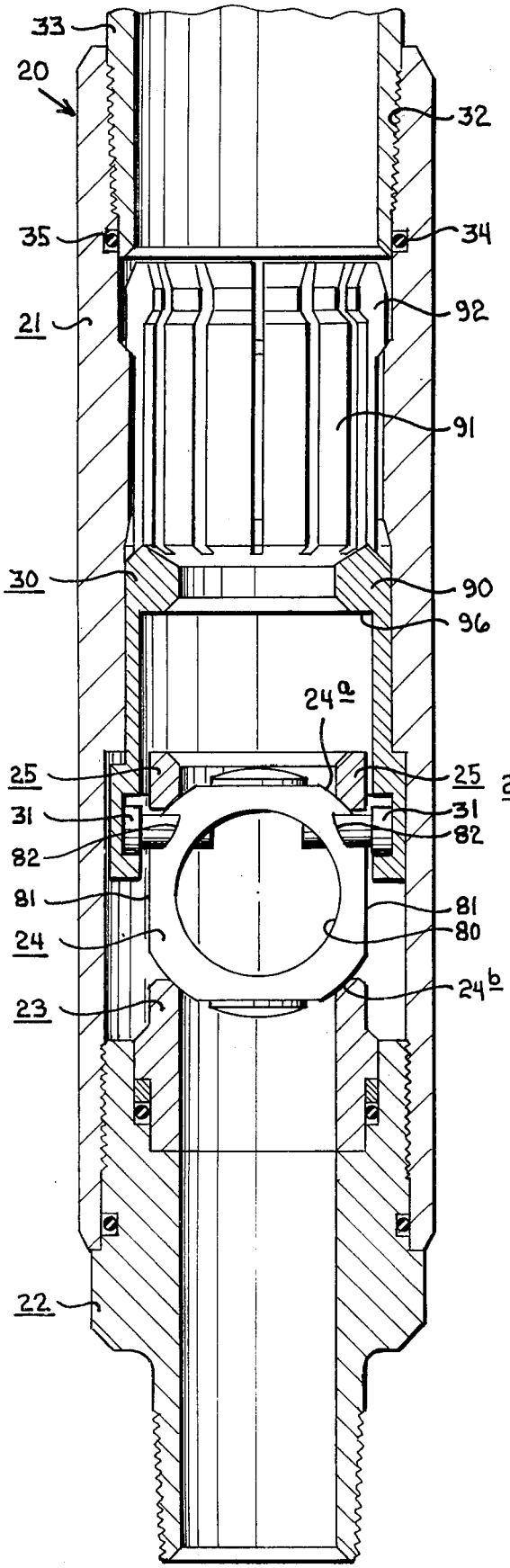
FIG. 3 is an enlarged fragmentary view in section and elevation of the well valve showing the valve closed.
Figure 4:
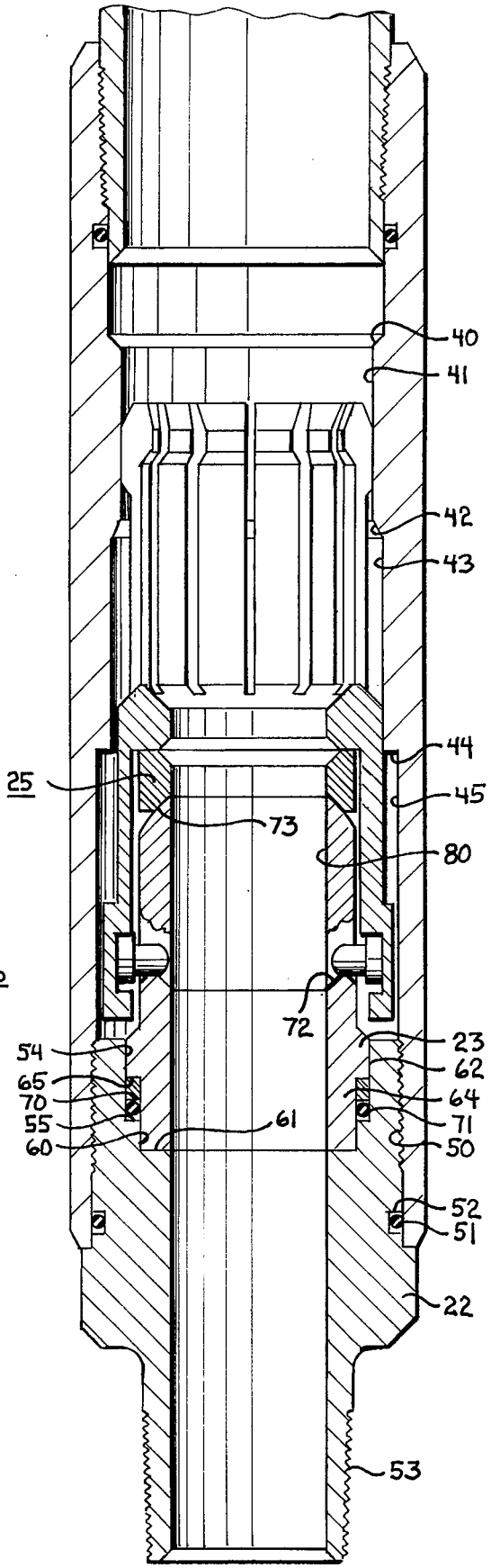
FIG. 4 is a fragmentary view in section and elevation similar to FIG. 3 showing the well valve open.

The ball valve member 24 is a spherical shape having a bore 80 extending entirely through the member as evident in FIG. 4. The valve member has flat opposite side faces 81 aligned parallel with each other and with the axis of the bore 80 and perpendicular to the axis of rotation of the valve member and pivot holes 82 extending from the opposite side faces 81 into the bore 80 aligned along an axis perpendicular to the side faces 81 and spaced from the axis of rotation of the valve member for coupling the pivots 31 with the member. The pivot holes 82 are offset from the axis of the member so that longitudinal movement of the pivots by the operator 30 between the positions of FIGS. 3 and 4 rotates the member 90° from the closed position of FIG. 3 to the open position of FIG. 4. Since the member is fixed longitudinally it rotates about a fixed axis with the holes 82 traversing a circular arc moving from the positions of FIG. 3 to that of FIG. 4.

Figure 9:
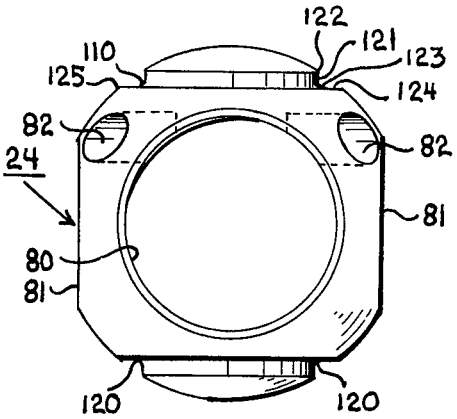
FIG. 9 is an enlarged end view in elevation of the ball valve member of the invention in the orientation shown in FIGS. 1 and 5 as viewed in a plane perpendicular to the axis of the bore through the valve member.
Figure 10:
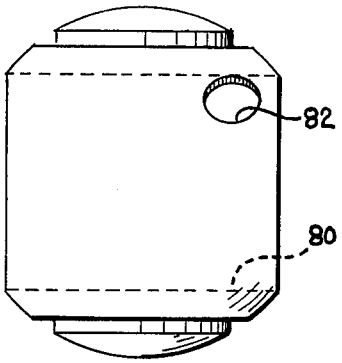
FIG. 10 is a side view in elevation of the valve member as illustrated in FIG. 9 as seen in a plane parallel to the axis through the bore of the valve member.
Figure 11:
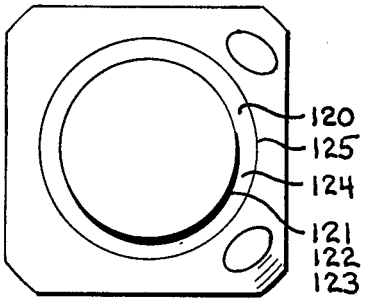
Figure 20:
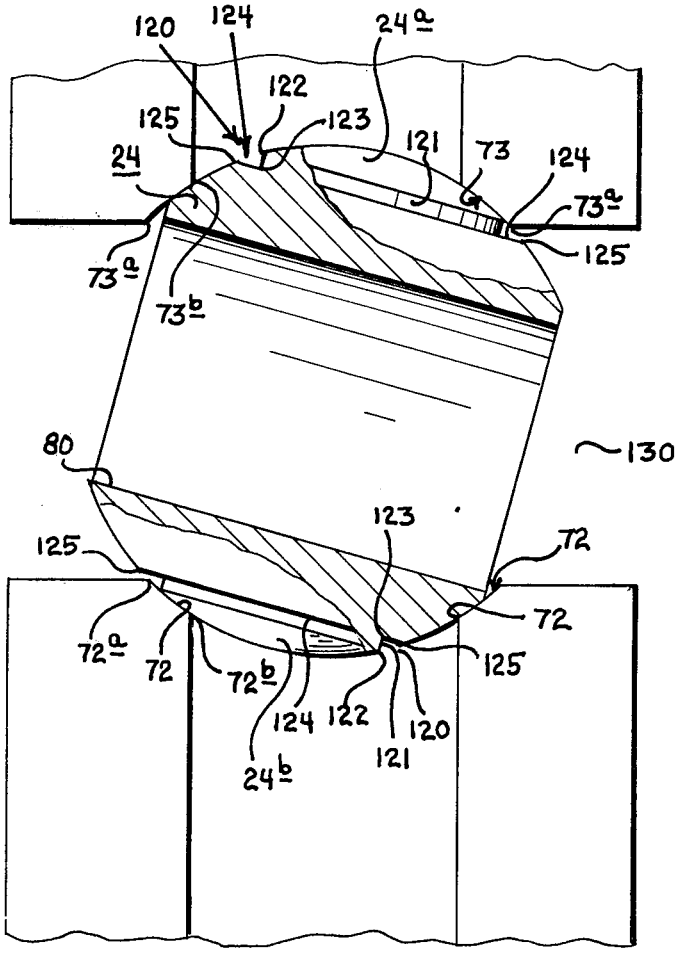
FIG. 20 is a side view partially in section and elevation of the ball valve member illustrated in FIGS. 9–11 mounted between the valve seats and rotated to a pressure equalizing position preliminary to full opening of the valve.

The valve member 24 has side sealing surfaces **24*a* and 24*b* on opposite sides of the bore 80 for engagement with the upper seat 25 and the lower seat 23, respectively. The surfaces 24*a* and 24*b* are spherical surface portions on the ball valve member positioned in diametrically opposed relationship on opposite sides of the ball disposed symmetrically between the side faces 81 of the ball valve member. The surfaces 24*a* and 24*b* are sufficient in size to fully engage the valve seat surfaces 73 and 72, respectively, as evident in FIG. 4. In accordance with the invention the ball valve member 24 is provided with equalizing flow courses formed on the side faces 24*a* and 24*b* of the member within the line of engagement of the inside edges of the seat surfaces 72 and 73 when the valve member is at the closed position as represented in FIG. 3. While the flow courses are shown in FIGS. 3–5, 9–11, and 20 as a circular groove, the flow courses on the valve member may also be any one or a combination of the designs represented in FIGS. 9–19 inclusive. In FIGS. 9–11 the equalizing flow courses are circular grooves 120 cut into the opposite faces 24*a* and 24*b* of the valve member. The grooves are each generated about an axis of the ball valve member extending perpendicular to and through the center of the axis of the bore of the ball valve member parallel to the side faces 81 of the valve member. The grooves 120 are each defined by a cylindrical surface 121 extending from an edge 122 to an inside corner 123 and a flat annular surface 124 extending from the corner 123 to an outer corner 125. To ensure full sealing contact between the spherical side surfaces of the ball valve member and the valve seat surfaces, when the ball valve member is closed as in the position illustrated in FIG. 3 the diameter of the corner edge 125 associated with each of the grooves 120 must be less than the diameter of the inner edge of the seat surface engaged by the ball valve member. For example, referring to FIG. 20, the seat surface 73 is a spherical annular surface on the upper valve seat 25 defined between the outer circular edge 73*a* and the inner circular edge 73*b*. Thus, the diameter of the ball valve member edge 125 must be less than the diameter of the seat surface edge 73*b* so that the groove 120 will not extend into the seat surface 73 when the ball valve member is at the fully closed position such as in FIG. 3. The grooves 120 on each of the opposite sides of the ball valve member 24 are identical. As shown in FIG. 20 the ball valve member side face 24*b* and the equalizing groove 120 in the side face coact with the lower valve seat surface 72 defined between the inner seat circular edge 72*b* and the outer circular edge 72*a* defining the lower annular spherical seat. The circular edge 125 of the lower groove 120 is smaller than the diameter of the lower seat edge 72*b* to ensure full sealing engagement between the ball valve member side surface 24*b* and the lower seat surface when the ball member is closed. The pressure equalizing function of the grooves 120 is explained in detail hereinafter in connection with the overall operation of the valve 20**.

Figure 7:
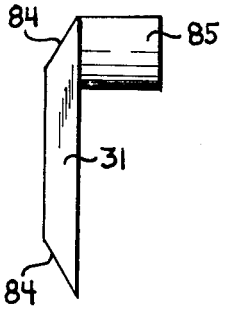
FIG. 7 is an enlarged side edge view of one of the ball valve pivots coupling the valve operator member with the ball valve member.
Figure 8:
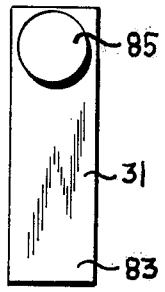
FIG. 8 is a side view in elevation as viewed from the right at 90° from the view of the pivot shown in FIG. 7.

The pivots 31 are shown in detail in FIGS. 7 and 8. Each of the pivots has a rectangular body 83 provided with tapered opposite outer end edge surfaces 84. A pivot pin 85 fits within one of the pivot holes 82 of the valve member 24. The pins are sized relative to the pivot holes to permit the valve member to rotate relative to the pivot pins as the pivots drive the member between the open and closed positions.

The valve operator 30 has a central ring portion 90, integral upwardly extending circumferentially spaced collet fingers 91 each having locking collet heads 92, and downwardly extending oppositely disposed operator legs 93. Each of the legs 93 is a cylindrical segment having an enlarged lower end portion 94 the upper end edge of each of which defines an upwardly facing stop shoulder 95 on each of the legs. The enlarged lower end portion 94 of each of the operator member legs has an internal transverse pivot slot 100 each of which receives the body portion 83 of one of the pivots 31 so that the pivot body may move transversely in the operator leg slot as the pivot pin transverses the required arcuate path to rotate the ball valve member between the open and closed positions. The operator legs 93 and the enlarged lower end portions 94 of the legs slide longitudinally along the side faces 73 of the upper valve seat 25 and the flat opposite side faces 81 of the ball valve member as the operator 30 is moved longitudinally to open and close the valve. In the particular arrangement of the valve as illustrated the locking collet heads 92 engage the locking surface 40 within the valve body at the upper end position of the valve operator 30 for releasably latching the valve operator at the upper valve closed position shown in FIG. 3.

Figure 2:
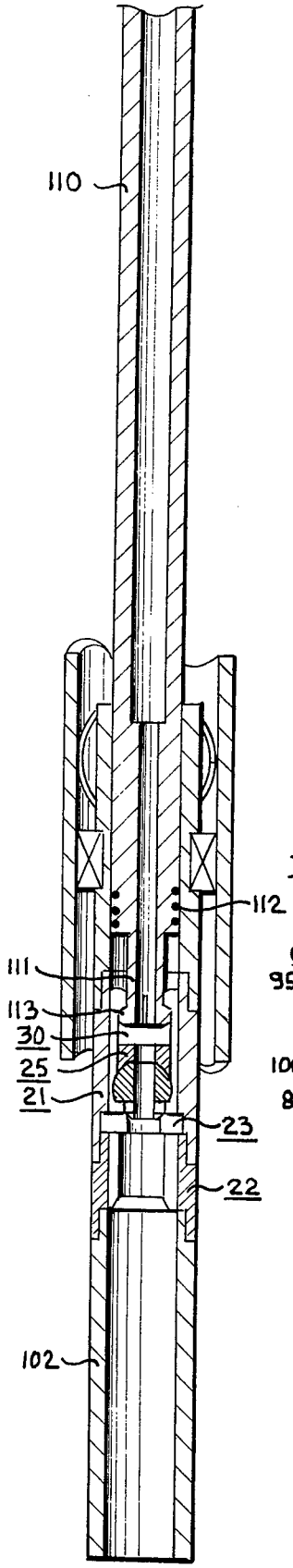
FIG. 2 is a schematic view similar to FIG. 1 showing the tubing string coupled into the valve opening the valve for well production or testing.

In a typical installation of the well valve 20 as illustrated in FIGS. 1 and 2, the valve is supported on the tubular lower end portion 33 of a standard Otis PERMA-TRIEVE Well Packer 100 as illustrated at page 3932–3935 of the 1974–75 edition of the *Composite Catalog of Oil Field Equipment and Services,* published by World Oil, Houston, Tex. The packer is installed by standard well completion procedures in the well casing 101. A string of lower well tubing 102 is supported from the lower end of the packer extending to a well producing zone, not shown, opening into the well bore below the packer. The valve 20 forms an integral part of the lower tubing string below the packer and is run with the packer when the packer is set in the well. The valve 20 is installed closed as represented in FIGS. 1 and 3 so that the well bore below the packer and valve are isolated from the well bore above the packer and valve.

In a well system equipped as illustrated in FIGS. 1 and 2, when communication from the well bore below the packer and valve to the surface is desired a string of upper tubing 110 is run from the surface. The tubing string is equipped with an operating collet 111 and external annular seals 112. The collet 111 engages and operates the operator member 30 of the well valve 20. The seals 112 form a seal between the lower end of the tubing string 110 and the packer bore. The collet 111 has locking heads 113. An operating shoulder 114 is formed on the lower end of the tubing string at the base ends of the fingers of the collet 111. As the tubing string 110 is lowered in the well bore through the packer 100 the collet 111 enters the collet fingers 91 of the well valve operator member 30. The collet heads 113 on the tubing string pass below the collet heads 92 in the valve operator. The operating shoulder 114 on the lower end of the upper tubing string engages the upper ends of the collet finger heads 92 of the valve operator. Continued lowering of the tubing string forces the valve operator 30 downwardly causing the tapered shoulder 40 within the valve body 21 to cam the collet heads 92 inwardly releasing the operator 30 to move downwardly. The collet finger heads cam inwardly around the collet 111 above the collet heads 113. The operator 30 is forced downwardly with the operator legs 92 forcing the pivots 31 downwardly so that the ball valve member 24 is rotated from the closed position shown in FIG. 3 to the open position of FIG. 4. As the collet operator legs force the pivots downwardly the pivots slide transversely in the slots 100 as the pivot pins 85 must traverse a circular arc in order to turn the ball valve 24 to the open position of FIG. 4. Both the upper and lower valve seats 25 and 23 respectively remain fixed longitudinally as the valve member 24 rotates about the axis of the member opening the valve. The ball valve member remains fixed longitudinally as it rotates. The downward stroke of the valve operator 30 is limited by the engagement of the bottom face 96 of the operator member ring 90 with the upper end edge of the upper seat 25 as shown in FIG. 4. The collet heads 92 on the valve operator move into the restricted bore portion of the valve body 21. The collet heads 92 are compressed around the collet 111 above the collet heads 113 on the collet 111. The valve 20 is thus fully open as shown in FIG. 4 with flow permitted upwardly through the valve into the tubing string 110. FIG. 2 illustrates the upper tubing string fully inserted through the packer into the well valve 20 holding the valve open so that flow may occur from the lower tubing string through the valve into the upper tubing string past the packer.

In accordance with the invention, as the ball valve member 24 is rotated to open the valve, the equalizing grooves 120 on the sealing faces of the ball valve member equalize the pressure across the valve member prior to the full opening of the member. Referring to FIG. 20, the ball valve member 24 is rotated clockwise for opening the valve member to communicate the bore of the upper valve seat with the bore of the lower valve seat through the bore 80 of the valve member. As the valve member rotates from the fully closed position of FIG. 3 toward the fully open position of FIG. 4 as represented in FIG. 20, when the outer edge 125 of the equalizing groove 120 on the upper side **24*a* of the ball valve member passes the right outer edge 73*a* of the upper valve seat, initial communication is established through the equalizing groove 120 between the bore of the upper valve seat and the valve body cavity 130 between the valve seats. At the same time the edge 125 of the equalizing groove 120 in the lower valve side surface 24*b* revolves upwardly past the outer edge 72*a* of the lower valve seat initiating communication through the equalizing groove 120 on the lower side of the ball valve member between the bore of the lower valve seat and the valve cavity between the valve seats. Thus, through the equalizing grooves on the upper and lower faces of the valve member pressure equalization is established across the valve member. When the ball valve member rotates, as soon as the groove edges 125 of both grooves pass the outer upper seat edge 73*a* and the outer lower seat edge 72*a*, the equalizing of pressures begins with major portions of the upper and lower seats and the upper and lower spherical valve member surfaces remaining in supporting contact so that the force concentration between the valve member and the valve seats is not substantially changed during pressure equalization. The only damage which may occur to the ball valve member and the seats is limited to the groove edges and the upper and lower seat outer edges 72*a* and 73*a***. This is in contrast with the damage which may occur when such a conventional ball valve member without the equalizing flow courses is rotated to open position in which case there is progressively decreasing contact between the ball valve member surfaces and the seat surfaces as the ball valve member bore edge rotates across the valve seat sealing surfaces. During the latter stages of opening a conventional ball valve member, just before fully open position is attained and with the full pressure differential still across the valve member, the stress concentrations become exceedingly high resulting in wire drawing or scoring the valve seat surfaces. This damage can be either or both mechanical damage from the high local force on the small area of contact between the ball valve member and the seat, or flow damage from the turbulence in the flowing fluid which occurs as the line contact is broken which is the first communication which occurs in the conventional ball type valve member not having the features of the invention. This damage is essentially eliminated in the present invention because of the support provided between the ball valve member and the seat surfaces inasmuch as during equalization the only areas of the ball valve member over which there is no mechanical support are only those areas of the equalizing flow courses as they revolve past the valve seats.

At the intermediate position of the ball valve member 24 as shown in FIG. 20 at which pressure equalization is beginning to take place, two segments of each of the equalizing flow courses 120 communicate the bores of the valve seats with the valve cavity 130 between the seats. For example, the two segments of the upper flow course 120 across the valve seat on the right side merge together and communicate past the right hand outer upper valve seat edge **73*a* into the cavity 130. These groove segments act as a flow choke while the ball valve member is moving between the open and shut positions. Also, the equalizing flow course segments are of considerable length so that the ball valve member may be positioned to operate in a throttling mode substantially better than a conventional ball valve. These groove segments not only serve as accurately controllable throttling means but also act as nozzles providing tangential jets which clean the interior of the valve mechanism such as the cavity 130** between the seals and the valve seat bore downstream from the valve member.

While the valve 20 is closed the ball valve member 24 in cooperation with the lower seat 23 holds against a pressure differential across the valve from either below the valve or above the valve. A higher pressure below the valve urges the lower valve seat 23 upwardly over an annular area defined between the line of sealing of the ring seal 71 with the lower valve seat and the line of sealing between the valve seat surface 72 on the lower valve seat and the ball valve member. If the higher pressure is above the valve the pressure acts downwardly over the closed ball valve member over an area defined on the valve member within the line of sealing engagement between the member and the lower valve seat surface 72 urging the member against the lower valve seat. Thus all of the sealing occurs between the ball valve member and the lower valve seat rather than with the upper valve seat 25.

When the upper tubing string 110 is retrieved upward movement of the collet heads 113 on the collet 111 engages the compressed collet heads 92 on the valve operator 30. The collet heads 113 pull the collet fingers 91 and the operator 30 of the well valve 20 upwardly rotating the ball valve member 24 back to the closed position of FIG. 3 and returning the valve operator 30 to the upper end position at which the collet heads 92 expand releasing the upper tubing string collet heads 113 from the collet heads 92 so that the upper tubing string may be retrieved leaving the valve 21 closed. Due to the relationship between the compressed collet heads 92 when the valve 20 is open and the upper tubing string collet heads 113 when fully inserted into the operator member 30 below the collet heads 92, the upper tubing string cannot be retrieved without reclosing the valve 20.

Thus, the well valve 20 is operable by a removable upper tubing string so that when the upper tubing is inserted into the valve, the valve is opened and when the upper tubing string is removed from the valve, the valve is left closed.

Figure 12:
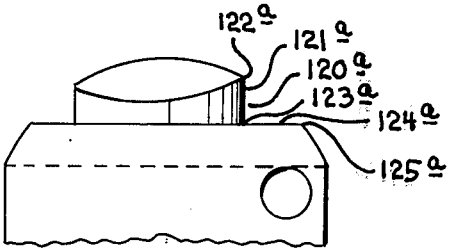
FIG. 12 is a fragmentary view of another form of the ball valve member using an eccentric flow course structure to provide varying flow course cross sections as the ball valve member is rotated.

While the preferred form of ball valve member in accordance with the invention includes the circular grooves 120 illustrated in FIGS. 9–11 and 20, there are numerous variations in the equalization flow course means which may be provided in a ball valve member within the scope of the invention. For example, by varying the diameter of the inside wall 121 of the groove 120 the cross sectional area of the groove is modified making the cross sectional area either larger or smaller to suit various pressure or fluid parameters. A further modification in the concept represented in the equalizing grooves **120*a* is represented in FIG. 12. Referring to FIG. 12, the equalizing groove 120*a* is a circular groove having an inner wall 121*a* formed on a center which is eccentric to the center line of the ball valve member. Otherwise, the groove 120*a* is formed identically to the groove 120. By forming the wall 121*a*** on the eccentric center line the cross section of the groove varies at different locations around the ball valve member. Thus, the flow capacity of the equalizing groove varies as the ball valve member rotates.

Figure 13:
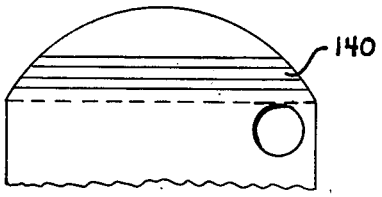
FIG. 13 is a fragmentary view of another form of the ball valve member using concentric fine surface grooves defining the equalizing flow course on each side of the ball valve member.
Figure 14:
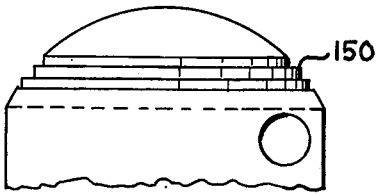
FIG. 14 is a fragmentary view of another ball valve member using concentric milled grooves on each side of the member defining the equalizing flow courses.
Figure 15:
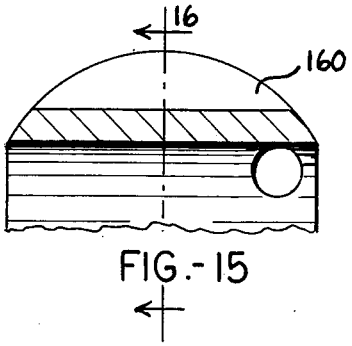
FIG. 15 is a fragmentary view of another ball valve member showing a slot cut across the ball valve member parallel with the axis of the bore on each side of the ball valve member defining the equalizing flow courses.
Figure 17:
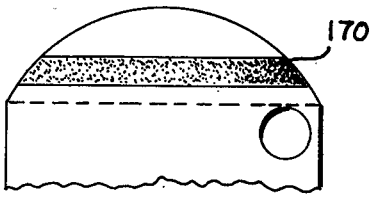
FIG. 17 is a fragmentary view of another ball valve member using an etched or sand blasted annular band around opposite sides of the ball valve member defining the equalizing flow courses.
Figure 16:
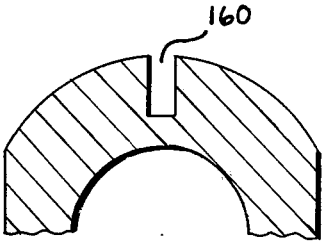
FIG. 16 is a view in section along the line 16—16 of FIG. 15.
Figure 18:
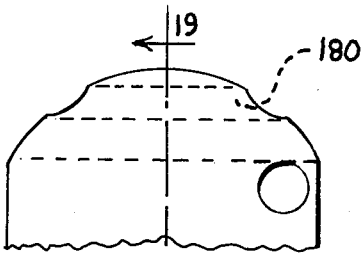
FIG. 18 is a fragmentary view of another form of ball valve member having a hole cut through opposite sides of the member parallel with the axis of the bore through the member defining the equalizing flow courses.
Figure 19:
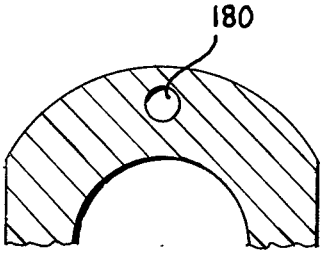
FIG. 19 is a view in section along the line 19—19 of FIG. 18.

Further modified forms of ball valve member equalizing flow courses are illustrated in FIGS. 13–19. FIG. 13 shows the equalizing flow courses as multiple fine grooves 140 providing an annular region on the ball valve member sealing surfaces in the form of a "phonograph" finish. FIG. 14 illustrates a ball valve member having a series of concentric circular milled grooves 150 formed in a sequential step pattern defining pressure equalizing flow course means. FIGS. 15 and 16 illustrate a ball valve member having a transverse slot 160 in the sealing face of the member formed parallel to and spaced from the bore of the valve member to provide an equalizing flow course. FIG. 17 illustrates a circular band or annular region 170 of the ball valve member which has been etched or sand blasted in the sealing face of the ball member to permit controlled leakage at intermediate ball valve member positions for pressure equalization and other valve functions which involve some leakage past the valve member. A further form of flow course means through the ball valve member includes a transverse hole 180 formed along opposite sides of the valve member parallel with the bore through the member as shown in FIGS. 18 and 19. As ball valve members having flow courses such as shown in FIGS. 13 and 18 are rotated toward open positions, pressure equalization begins as soon as the advancing end of the flow course hole or slot is revolved past the outer edge of the valve seat permitting communication through the flow course past the seat.

It will be evident that each of the forms of modified ball valve members shown in FIGS. 12–19 will function in the same fashion as previously described in connection with FIG. 20. It will also be evident that further forms of ball valve members embodying the features of the invention may include any desired combination of the various flow course designs illustrated and described. For example, one side of the ball valve member may include a circular groove such as groove 120 while the other side of the member may include a hole such as the hole 180 shown in FIGS. 18 and 19. In some valve designs where only one sealing face of the ball valve member functions with a single seat surface, the equalizing flow course means is provided only in the single sealing face.

In most high pressure ball valve application, one of the valve seats provides the necessary sealing function while the other seat acts as a mechanical bearing to keep the ball valve member and the sealing seat in intimate contact to protect the sealing surface of the seat. The pressure differential can be either in the direction of the sealing seat to utilize both the ball area and the seal area to create high sealing stresses or the pressure differential may be in a direction away from the sealing seat to minimize sealing stress to protect the sealing surfaces from undue wear. Either arrangement of valve apparatus, whether sealing on the upstream seat or the downstream seat, can be improved by use of the pressure equalizing groove means in accordance with the invention.

In actual tests of a ball valve member installed in valve apparatus of the nature disclosed herein, the operating force required to turn the ball valve member was significantly reduced. Operating the valve under a pressure of 5000 psi, the opening force was reduced from 17000 pounds required for a conventional ball valve member which had not been grooved to 11000 pounds when the ball valve member was grooved in accordance with the invention. The improvement in efficiency is believed due both to the effect of the operating pressure in the groove of the ball valve member during movement of the member prior to opening the valve and the reduction in the angular travel of the ball valve member under the full pressure of the pressure differential across the member. The pressure within the groove prior to opening tends to reduce the force concentration between the seat and the valve member prior to opening and the pressure equalization occurs substantially before full opening of the valve member.

It will now be seen that a new and improved ball valve member has been described and illustrated which offers numerous advantages over conventional ball valve members. The ball valve member includes various forms of flow course configurations which permit pressure equalization prior to full valve opening thereby reducing the stress concentration between the valve member and the valve seat as the valve member is rotated.

What is claimed is:

1. An equalizing ball valve member for use in valve apparatus to control fluid flow through said apparatus comprising: a spherical body having a bore therethrough defining a flow passage through said body and at least one side sealing surface on said body for coacting with a spherical annular seat surface for permitting fluid flow through said apparatus when said ball valve member is rotated to a position aligning said bore within said annular seat surface and for closing said apparatus to fluid flow when said ball valve member is rotated to a position at which said bore is misaligned from said annular seat surface and said side sealing surface on said ball valve member is engaged with said annular seat surface; and said spherical body being provided with equalizing flow course means on said side sealing surface over an area smaller than the area within the inner edge of said annular seat surface to permit limited fluid flow past said valve member while remaining in intimate contact with said annular seat surface at a position of rotation of said valve member between a closed position and prior to rotation of said ball valve member to a position at which said bore communicates through said annular seat surface.

2. An equalizing ball valve member in accordance with claim 1 wherein said equalizing flow course means comprises a circular groove formed in said side sealing surface generated about an axis of said spherical body extending perpendicular to and through the center of the axis of said bore through said body.

3. An equalizing ball valve member in accordance with claim 2 wherein said circular groove is smaller in diameter than the inside edge of said annular seat surface.

4. An equalizing ball valve member in accordance with claim 2 wherein said circular groove is defined by a cylindrical inside wall surface generated about said axis of said circular groove and a contiguous annular plane surface perpendicular to said axis of said cylindrical surface and parallel to said axis of said bore through said spherical body.

5. An equalizing ball valve member in accordance with claim 4 wherein the outer edge of said annular plane surface is smaller in diameter than the inner edge of said annular seat surface.

6. An equalizing ball valve member for use in valve apparatus to control fluid flow through said apparatus comprising: a spherical body having a bore therethrough defining a flow passage through said body and at least one side sealing surface on said body for coacting with a spherical annular seat surface for permitting fluid flow through said apparatus when said ball valve member is rotated to a position aligning said bore within said annular seat surface and for closing said apparatus to fluid flow when said ball valve member is rotated to a position at which said bore is misaligned from said annular seat surface and said side sealing surface on said ball valve member is engaged with said annular seat surface; and said spherical body being provided with equalizing flow course means on said side sealing surface comprising a circular groove generated about an axis eccentric to a line extending perpendicular to and through the center line of the axis of said bore through said spherical body to permit limited fluid flow past said valve member while remaining in intimate contact with said annular seat surface at a position of rotation of said valve member between a closed position and prior to rotation of said ball valve member to a position at which said bore communicates through said annular seat surface.

7. An equalizing ball valve member in accordance with claim 6 wherein the diameter of said circular groove is less than the diameter of the inner edge of said annular seat surface.

8. An equalizing ball valve member in accordance with claim 6 wherein said circular groove is defined by a cylindrical inside wall surface generated about said eccentric axis and a contiguous annular plane surface lying perpendicular to said eccentric axis and parallel with said axis of said bore of said spherical body.

9. An equalizing ball valve member in accordance with claim 8 wherein said annular plane is smaller in diameter than the inner edge of said circular seat surface.

10. An equalizing ball valve member for use in valve apparatus to control fluid flow through said apparatus comprising: a spherical body having a bore therethrough defining a flow passage through said body and at least one side sealing surface on said body for coacting with a spherical annular seat surface for permitting fluid flow through said apparatus when said ball valve member is rotated to a position aligning said bore within said annular seat surface and for closing said apparatus to fluid flow when said ball valve member is rotated to a position at which said bore is misaligned from said annular seat surface and said side sealing surface on said ball valve member is engaged with said annular seat surface; and said spherical body being provided with equalizing flow course means comprising a plurality of fine contiguous concentric annular grooves on said side sealing surface generated about an axis extending perpendicular to and through the center of the axis of said bore through said spherical body to permit limited fluid flow past said valve member while remaining in intimate contact with said annular seat surface at a position of rotation of said valve member between a closed position and prior to rotation of said ball valve member to a position at which said bore communicates through said annular seat surface.

11. An equalizing ball valve member in accordance with claim 10 wherein the largest of said annular grooves is smaller in diameter than the inner edge of said annular seat surface.

12. An equalizing ball valve member for use in valve apparatus to control fluid flow through said apparatus comprising: a spherical body having a bore therethrough defining a flow passage through said body and at least one side sealing surface on said body for coacting with a spherical annular seat surface for permitting fluid flow through said apparatus when said ball valve member is rotated to a position aligning said bore within said annular seat surface and for closing said apparatus to fluid flow when said ball valve member is rotated to a position at which said bore is misaligned from said annular seat surface and said side sealing surface on said ball valve member is engaged with said annular seat surface; and said spherical body being provided with equalizing flow course means on said side sealing surface comprising a plurality of concentric contiguous milled annular grooves generated about a single axis extending perpendicular to and through the center of said axis of said bore through said spherical body to permit limited fluid flow past said valve member while remaining in intimate contact with said annular seat surface at a position of rotation of said valve member between a closed position and prior to rotation of said ball valve member to a position at which said bore communicates through said annular seat surface.

13. An equalizing ball valve member in accordance with claim 12 wherein the largest of said grooves is smaller in diameter than the inner edge of said annular seat surface.

14. An equalizing ball valve member for use in valve apparatus to control fluid flow through said apparatus comprising: a spherical body having a bore therethrough defining a flow passage through said body and at least one side sealing surface on said body for coacting with a spherical annular seat surface for permitting fluid flow through said apparatus when said ball valve member is rotated to a position aligning said bore within said annular seat surface and for closing said apparatus to fluid flow when said ball valve member is rotated to a position at which said bore is misaligned from said annular seat surface and said side sealing surface on said ball valve member is engaged with said annular seat surface; and said spherical body being provided with equalizing flow course means comprising an annular band on said side sealing surface etched in said surface over an area smaller than the area within the inner edge of said annular seat surface about an axis extending perpendicular to and through the center of said axis of said bore through said spherical body to permit limited fluid flow past said valve member while remaining in intimate contact with said annular seat surface at a position of rotation of said valve member between a closed position and prior to rotation of said ball valve member to a position at which said bore communicates through said annular seat surface.

15. An equalizing ball valve member in accordance with claim 14 wherein the diameter of the outer edge of said annular band is smaller than the inner edge of said annular seat surface.

16. An equalizing ball valve member for use in valve apparatus to control fluid flow through said apparatus comprising: a spherical body having a bore therethrough defining a flow passage through said body and at least one side sealing surface on said body for coacting with a spherical annular seat surface for permitting fluid flow through said apparatus when said ball valve member is rotated to a position aligning said bore within said annular seat surface and for closing said apparatus to fluid flow when said ball valve member is rotated to a position at which said bore is misaligned from said annular seat surface and said side sealing surface on said ball valve member is engaged with said annular seat surface; and said spherical body being provided with equalizing flow course means comprising a transverse slot formed in said side sealing surface extending parallel to and spaced from said bore through said spherical body to permit limited fluid flow past said valve member while remaining in intimate contact with said annular seat surface at a position of rotation of said valve member between a closed position and prior to rotation of said ball valve member to a position at which said bore communicates through said annular seat surface.

17. An equalizing ball valve member in accordance with claim 16 wherein the opposite ends of said slot are closer together than the diameter of the inner edge of said annular seat surface.

18. An equalizing ball valve member for use in valve apparatus to control fluid flow through said apparatus comprises: a spherical body having a bore therethrough defining a flow passage through said body and at least one side sealing surface on said body for coacting with a spherical annular seat surface for permitting fluid flow through said apparatus when said ball valve member is rotated to a position aligning said bore within said annular seat surface and for closing said apparatus to fluid flow when said ball valve member is rotated to a position at which said bore is misaligned from said annular seat surface and said side sealing surface on said ball valve member is engaged with said annular seat surface; and said spherical body being provided with equalizing flow course means comprising a transverse hole extending through said spherical body parallel to and spaced from said bore through said body and opening at opposite ends through said side sealing surface to permit limited fluid flow past said valve member while remaining in intimate contact with said annular seat surface at a position of rotation of said valve member between a closed position and prior to rotation of said ball valve member to a position at which said bore communicates through said annular seat surface.

19. An equalizing ball valve member in accordance with claim 18 wherein the length of said hole is less than the diameter of the inner edge of said annular seat surface.

20. An equalizing ball valve member for use in valve apparatus for controlling fluid flow through said valve apparatus comprising: a spherical body member; means in said body member defining a cylindrical bore therethrough generated on a longitudinal axis coincident with the center of said body member and perpendicular to the axis of rotation of said body member; means defining two plane operating surfaces disposed in parallel spaced relationship along opposite sides of said body member aligned parallel with the longitudinal axis of said bore through said body member and perpendicular to the axis of rotation of said body member; means providing two operator pin holes in opposite sides of said body member aligned on an axis spaced from the axis of rotation of said spherical member and perpendicular to said plane surfaces; means defining spherical seal surface portions on said body member on opposite sides of said body member disposed in symmetrical relationship between said plane surfaces of said body member, said seal surfaces being located to engage two annular spherical valve seats disposed on opposite sides of said spherical body member engageable with said spherical seal surface portions for closing said valve apparatus when said body member is at a position of rotation at which said bore is misaligned from said seat surfaces and for opening said valve apparatus when said body member is at a position of rotation at which said bore through said body member is aligned within said annular seat surfaces; and means on said opposite seal surfaces of said body member defining equalizing flow course means on each of said seal surfaces, each of said flow course means on each of said seal surfaces being sized to lie within the line of engagement of the inner edge of the annular spherical seat surface of said valve apparatus in contact with each of said valve member seal surfaces when said valve member is at a fully closed position in said valve apparatus when said longitudinal axis of said bore through said valve member is perpendicular to the axis extending through said annular seat surfaces on opposite sides of said valve member.

21. An equalizing ball valve member in accordance with claim 20 wherein said equalizing flow course means in each of said seal surfaces is a circular groove formed in each of said surfaces on a center coincident with an axis through the center line of said spherical body member extending parallel with said plane side surfaces and perpendicular to said longitudinal axis of said bore.

22. A ball valve member in accordance with claim 20 wherein said equalizing flow course means on each of said seal surfaces comprises a circular groove formed in each of said surfaces on an axis extending parallel to and midway between said plane side perpendicular to the longitudinal axis of said bore through said body and eccentric to the center of said spherical body whereby the cross-section area of said equalizing groove means varies at the line of engagement of said side seal surfaces with said annular seats as said ball valve member is rotated between open and closed positions for providing flow rate variation through said equalizing flow course means at different positions of rotation of said ball valve member.

23. A ball valve member in accordance with claim 20 wherein said equalizing flow course means on each of said seal surfaces comprising a plurality of contiguous concentric fine grooves defining an annular phonograph finish band on each of said seal surfaces generated about a center line extending parallel with said plane side surfaces through the center of said spherical body perpendicular to the longitudinal axis of said bore.

24. A ball valve member in accordance with claim 20 wherein said equalizing flow course means on each of said seal surfaces comprises a plurality of concentric contiguous milled grooves generated about a common center line extending parallel with said plane side surfaces through the center of said spherical body perpendicular to the longitudinal axis of said bore through said body.

25. A ball valve member in accordance with claim 20 wherein said equalizing flow course means comprises a circular etched band on each of said side seal surfaces of said body generated about a center line extending parallel to said plane side surfaces through the center of said spherical body perpendicular to said longitudinal axis of said bore through said body.

26. A ball valve member in accordance with claim 20 wherein said flow course means in each of said side seal surfaces of said body comprises a longitudinal slot opening through the spherical surface of each of said seal surfaces formed in spaced relationship from said bore through said body extending parallel with and midway between said plane side surfaces of said body and parallel with the longitudinal axis through said bore of said body.

27. A ball valve member in accordance with claim 20 wherein said equalizing flow course means in each of said side seal surfaces comprises a hole extending parallel with and spaced from said bore through said body parallel with and midway between said plane side surfaces, the opposite ends of each of said holes in each of said seal surfaces opening through said seal surfaces.

* * * * *